US008338653B2

(12) United States Patent
Sekiguchi et al.

(10) Patent No.: US 8,338,653 B2
(45) Date of Patent: Dec. 25, 2012

(54) LUBRICATING OIL FOR NON-STAGE TRANSMISSION

(75) Inventors: Hiroki Sekiguchi, Sodegaura (JP); Yukio Yoshida, Sodegaura (JP); Sumihiro Oda, Sodegaura (JP); Toshiyuki Tsubouchi, Sodegaura (JP); Hidetoshi Koga, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 246 days.

(21) Appl. No.: 12/665,943

(22) PCT Filed: Jun. 24, 2008

(86) PCT No.: PCT/JP2008/061461

§ 371 (c)(1),
(2), (4) Date: Dec. 22, 2009

(87) PCT Pub. No.: WO2009/001821

PCT Pub. Date: Dec. 31, 2008

(65) Prior Publication Data

US 2010/0179079 A1 Jul. 15, 2010

(30) Foreign Application Priority Data

Jun. 25, 2007 (JP) ..... 2007-166808

(51) Int. Cl.
*C10M 169/04* (2006.01)
*C10M 105/04* (2006.01)
*C07C 13/28* (2006.01)

(52) U.S. Cl. ..... 585/22; 585/20; 585/21; 508/110; 252/73

(58) Field of Classification Search ..... 585/21, 585/22; 508/110
See application file for complete search history.

(56) References Cited

U.S. PATENT DOCUMENTS

| | | | | |
|---|---|---|---|---|
| 5,283,384 | A * | 2/1994 | Abe et al. | 585/22 |
| 6,187,979 | B1 | 2/2001 | Ido et al. | |
| 6,319,879 | B1 * | 11/2001 | Yoshida et al. | 508/110 |
| 6,828,283 | B2 * | 12/2004 | Chapaton et al. | 508/110 |
| 7,015,178 | B2 * | 3/2006 | Koga et al. | 508/463 |
| 7,402,715 | B2 * | 7/2008 | Yoshida et al. | 585/1 |
| 7,956,226 | B2 * | 6/2011 | Tsubouchi et al. | 585/12 |
| 7,964,540 | B2 * | 6/2011 | Yoshida et al. | 508/110 |
| 2002/0072476 | A1 * | 6/2002 | Yoshida et al. | 508/110 |
| 2004/0181102 | A1 | 9/2004 | Yoshida et al. | |
| 2007/0042915 | A1 | 2/2007 | Yoshida et al. | |

FOREIGN PATENT DOCUMENTS

| | | |
|---|---|---|
| EP | 0 968 987 | 1/2000 |
| JP | 2000 17280 | 1/2000 |
| JP | 2000 204386 | 7/2000 |
| JP | 2001 247492 | 9/2001 |
| WO | 03 014268 | 2/2003 |
| WO | 2005 035699 | 4/2005 |

* cited by examiner

*Primary Examiner* — Ellen McAvoy
(74) *Attorney, Agent, or Firm* — Oblon, Spivak, McClelland, Maier & Neustadt, L.L.P.

(57) ABSTRACT

Provided is a lubricating oil for continuously variable transmissions characterized by that used as a base oil are a synthetic oil I having the following properties:

(a) a traction coefficient at 120° C. is 115% or more of that of 2,4-dicyclohexyl-2-methylpentane, (b) a viscosity at −40° C. is not higher than a viscosity (260 Pa·s) of 2,4-dicyclohexyl-2-methylpentane, and (c) a viscosity index is 65 or higher, and a synthetic oil II having a viscosity of 1 Pa·s or lower at −40° C. and that the above base oil has a specific property. The above lubricating oil is a lubricating oil for continuously variable transmissions which has a high traction coefficient even at high temperature and is endowed with a good low temperature fluidity and which is suited as a lubricating oil for continuously variable transmissions for automobiles.

11 Claims, No Drawings

LUBRICATING OIL FOR NON-STAGE TRANSMISSION

CROSS-REFERENCE TO RELATED APPLICATIONS

This application is a National Stage of PCT/JP08/061461 filed Jun. 24, 2008 and claims the benefit of JP 2007-166808 filed Jun. 25, 2007.

BACKGROUND OF THE INVENTION

The present invention relates to a lubricating oil for non-stage transmissions (hereinafter may be referred to as "continuously variable transmissions"), more specifically to a lubricating oil for continuously variable transmissions which has a high traction coefficient even at high temperature and is endowed with a good low temperature fluidity and which is suited as a lubricating oil for continuously variable transmissions for automobiles.

Related Art

A continuously variable transmission (hereinafter referred to as CVT), particularly CVT for automobiles has such severe use conditions that a torque transmission capacity is large and that a fluctuation range of temperature is wide, and therefore a lubricating oil used for a continuously variable transmission is required to have a high traction coefficient over a use temperature range in order to achieve sufficiently high power transmission. Accordingly, since a lubricating oil is reduced usually in a traction coefficient as an oil temperature rises, a lowest value of a traction coefficient of a lubricating oil for a continuously variable transmission, that is, a traction coefficient thereof at high temperature (120° C.) is required to be sufficiently higher than a design value of CVT.

Further, a lubricating oil for a continuously variable transmission assumes a role of a normal lubricating oil in CVT, and therefore it has to have such a high viscosity that a satisfactory oil film can be maintained even at high temperature.

On the other hand, a lubricating oil is required to have a low viscosity (low temperature fluidity) even at low temperature in order to start engines at low temperature in cold districts such as North America, North Europe and the like. That is, a lubricating oil for a continuously variable transmission has to be small in a change of a viscosity caused by a temperature change, in other words, a viscosity index has to be high.

Under such circumstances, the present inventors disclosed previously a fluid for traction drive (refer to a patent document 1) prepared by using a synthetic oil having specific physical properties as a base oil and a lubricant base oil (refer to a patent document 2) which contains at least one hydrocarbon compound having a specific structure as a basic skeleton and which has a high traction coefficient at high temperature, a low viscosity at −40° C. and a high viscosity index.

On the other hand, regulations on fuel consumption are being strengthened in many countries in recent years because of a rise in concerns about environmental problems. CVT tends to be employed in order to meet an increase in needs for a rise in fuel consumption. Since a speed can be varied at a single step in CVT, an optimum engine revolution can be selected based on a required output torque, and a fuel consumption improving effect is large. CVT includes a metal belt system, a chain system, a traction drive system and the like, and a high transmission efficiency is required in all systems. Then, lubricating oils having a high traction coefficient are required to be developed, and the transmission efficiency has to be enhanced.

Also, since a speed is varied at a single step in CVT, it does not have a gear change shock and is free from a fall in an engine revolution in elevating a shift, and therefore it is improved in an acceleration performance and excellent in a drivability.

Further, CVT is loaded as well in large-sized automobiles and trucks in increasing examples. Such large-sized automobiles have a high torque capacity, and therefore lubricating oils having a higher traction coefficient than ever are desired to be developed.

Patent document 1: Japanese Patent Application Laid-Open No. 17280/2000

Patent document 2: WO 2005/035699

DISCLOSURE OF THE INVENTION

The present invention has been made under the situations described above, and an object of the present invention is to provide a lubricating oil for continuously variable transmissions which has a high traction coefficient even at high temperature and is endowed with a good low temperature fluidity and which is suited as a lubricating oil for continuously variable transmissions for automobiles.

Intensive researches repeated by the present inventors in order to develop a lubricating oil for continuously variable transmissions which has the preferred properties described above have resulted in finding that the above object can be achieved by using a synthetic oil having specific properties as a base oil. The present invention has been completed based on the above knowledge.

That is, the present invention provides:

(1) a lubricating oil for continuously variable transmissions characterized by that used as a base oil are a synthetic oil I having the following properties:

(a) a traction coefficient at 120° C. is 115% or more of that of 2,4-dicyclohexyl-2-methylpentane, (b) a viscosity at −40° C. is not more than a viscosity (260 Pa·s) of 2,4-dicyclohexyl-2-methylpentane and (c) a viscosity index is 65 or more and a synthetic oil II having a viscosity of 1 Pa·s or less at −40° C. and that the above base oil has the following properties:

(a') a traction coefficient at 120° C. is 110% or more of that of 2,4-dicyclohexyl-2-methylpentane, (b') a viscosity at −40° C. is 130 Pa·s or less and (c') a viscosity index is 70 or more, (2) the lubricating oil for continuously variable transmissions according to the above item (1), wherein a viscosity of the base oil at −40° C. is 60 Pa·s or less, (3) the lubricating oil for continuously variable transmissions according to the above item (1) or (2), wherein the synthetic oil I is a compound containing two bicyclo[2.2.1] heptane ring compounds and having no multiple bond, (4) the lubricating oil for continuously variable transmissions according to any of the above items (1) to (3), wherein the synthetic oil I is a hydrogenation product of a dimer of the bicyclo[2.2.1]heptane ring compound, (5) the lubricating oil for continuously variable transmissions according to any of the above items (1) to (4), wherein the synthetic oil II is at least one compound selected from hydrocarbon compounds represented by the following Formulas (IV) to (IX):

[Ka 1]

(IV)

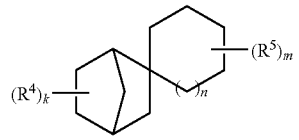

-continued (V)

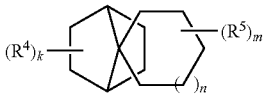

(VI)

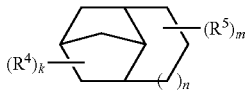

(VII)

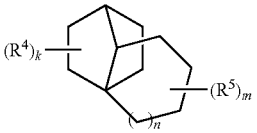

(VIII)

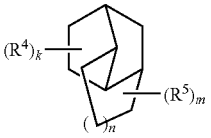

(IX)

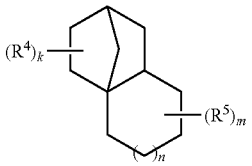

(wherein $R^4$ and $R^5$ each represent independently an alkyl group having 1 to 3 carbon atoms; k and m each represent independently an integer of 0 to 6, and n represents an integer of 0 to 2; and when plural $R^4$ and $R^5$ are present, plural $R^4$ and $R^5$ may be the same or different) and (6) the lubricating oil for continuously variable transmissions according to any of the above items (1) to (5), comprising at least one additive selected from an antioxidant, a viscosity index improver, a detergent dispersant, a friction modifier, a metal deactivator, a pour point depressant, an anti-wear agent, a deformer and an extreme pressure agent.

According to the present invention, capable of being provided is a lubricating oil for continuously variable transmissions which has a high traction coefficient even at high temperature and is endowed with a good low temperature fluidity and which is suited as a lubricating oil for continuously variable transmissions for automobiles.

BEST MODE FOR CARRYING OUT THE INVENTION

The lubricating oil for continuously variable transmissions according to the present invention (hereinafter referred to merely as the lubricating oil of the present invention) is characterized by that used as the base oil are the synthetic oil I having the following properties:

(a) a traction coefficient at 120° C. is not lower than 115% of that of 2,4-dicyclohexyl-2-methylpentane, (b) a viscosity at −40° C. is not higher than a viscosity (260 Pa·s) of 2,4-dicyclohexyl-2-methylpentane and (c) a viscosity index is 65 or higher and the synthetic oil II having a viscosity of 1 Pa·s or lower at −40° C. and that the above base oil has a specific property.

In the lubricating oil of the present invention, a traction coefficient of the synthetic oil I constituting the base oil at 120° C. has to be not lower than 115% of that of 2,4-dicyclohexyl-2-methylpentane (hereinafter abbreviated as DC2MP). DC2MP is commercially available as a base oil for industrial traction drive fluids. If a traction coefficient of the synthetic oil I is less than 115% of that of DC2MP, the traction coefficient at high temperature is low, and when the synthetic oil II of a low viscosity described later is mixed, the traction coefficient is further reduced to make it impossible to load the lubricating oil in automobiles having a high torque capacity. Further, a design value of CVT can not be raised, and the transmission efficiency is inferior.

The traction coefficient described above is more preferably not lower than 120% of that of DC2M. An upper limit thereof shall not specifically be restricted as long as the other performances are satisfied.

The traction coefficient described above is a value determined by measuring by the following method.

<Measurement of the Traction Coefficient>

The traction coefficient at 120° C. was measured by means of a dual cylindrical rolling sliding frictional test equipment. That is, one of the cylinders (diameter: 52 mm, thickness: 6 mm, driven side: drum type having a curvature radius of 10 mm, driving side: flat type having no crowning) of the same size which were brought into contact was driven at a constant speed, and a revolving speed of the other cylinder was varied continuously; a load of 98.0N was applied to a contact part of both cylinders by means of a spindle to measure a tangential force generated between both cylinders, that is, the traction force, whereby the traction coefficient was determined. The above cylinders were endowed with bearing steel SUJ-2 mirror finish and had an average circumferential velocity of 6.8 m/second and a maximum hertz contact pressure of 1.23 GPa. Also, in measuring the traction coefficient at a fluid temperature (oil temperature) of 120° C., the oil temperature was elevated from 40° C. up to 140° C. by heating the oil tank by means of a heater to determine the traction coefficient at a slide-roll ratio of 5%.

A viscosity of the synthetic oil I at −40° C. has to be not higher than a viscosity (260 Pa·s) of DC2MP. If the above viscosity exceeds a viscosity (260 Pa·s) of DC2MP, the lubricating oil is less liable to be used in cold districts such as North America, North Europe and the like. The viscosity at −40° C. is preferably 130 Pa·s or less, more preferably 100 Pa·s or less and further preferably 60 Pa·s or less.

In order to lower the viscosity at −40° C., a small amount of the synthetic oil II described later having a low viscosity is preferably added to inhibit the traction coefficient from being lowered and reduce the viscosity.

The above viscosity at −40° C. is a value obtained by measuring the Brookfield viscosity according to ASTM D2983.

The above synthetic oil I has to have a viscosity index of 65 or higher. If the above viscosity index is lower than 65, the viscosity at high temperature is short to become a cause of bringing about oil film breaking. The above viscosity index is preferably 70 or higher, more preferably 75 or higher and further preferably 80 or higher.

The viscosity index described above is a value measured according to "Petroleum product kinematic viscosity test method" prescribed in JIS K 2283.

In the lubricating oil for continuously variable transmissions according to the present invention, the synthetic oil II having a viscosity of 1 Pa·s or less at −40° C. is used as the base oil together with the synthetic oil I described above, and the above base oil has to have the following properties:

(a') a traction coefficient at 120° C. is preferably 110% or more, more preferably 115% or more of that of DC2MP, (b') a viscosity at −40° C. is preferably 130 Pa·s or less, more preferably 100 Pa·s or less and further preferably 60 Pa·s or less and (c') a viscosity index is preferably 70 or more, more preferably 75 or more and further preferably 80 or more.

Synthetic Oil I:

In the lubricating oil of the present invention, the synthetic oil I constituting the base oil is preferably a compound containing two bicyclo[2.2.1]heptane ring compounds and having no multiple bond. To be specific, it includes, for example, a compound which has two bicyclo[2.2.1]heptane rings and which may be substituted with at least one alkyl group (preferably methyl) having 1 to 3 carbon atoms and has a molecular weight of 200 to 400.

The compound having no multiple bond is a compound which does not contain a double bond, a triple bond, an aromatic bond and the like, and it can be obtained usually by passing through a hydrogenation step in the production step.

Among such compounds, a hydrogenation product of a dimer of the bicyclo[2.2.1]heptane ring compound is particularly preferred.

The above compound includes, for example, a compound represented by the following Formula (I):

[Ka 2]

(I)

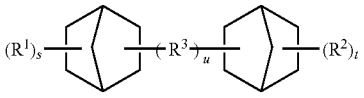

(wherein $R^1$ and $R^2$ each represent independently an alkyl group having 1 to 3 carbon atoms; $R^3$ represents methylene, ethylene or trimethylene which may be substituted with methyl or ethyl in a side chain; s and t each represent an integer of 0 to 3, and u represents 0 or 1).

Among the compounds represented by Formula (I) described above, a compound represented by the following Formula (I-a) is particularly preferred:

[Ka 3]

(I-a)

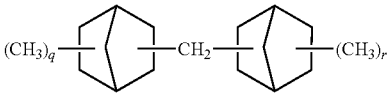

(wherein q represents an integer of 1 or 2, and r represents an integer of 2 or 3).

The compound represented by Formula (I-a) described above includes preferably, for example, endo-2-methyl-exo-3-methyl-exo-2-[(exo-3-methylbicyclo[2.2.1]hepto-exo-2-yl)methyl]-bicyclo[2.2.1]heptane and endo-2-methyl-exo-3-methyl-exo-2-[(exo-2-methylbicyclo[2.2.1]hepto-exo-3-yl)methyl]-bicyclo[2.2.1]heptane which are represented by the following Formula (II) and endo-2-methyl-exo-3-methyl-exo-2-[(endo-3-methylbicyclo[2.2.1]hepto-endo-2-yl)methyl]bicyclo[2.2.1]-heptane and endo-2-methyl-exo-3-methyl-exo-2-[(endo-2-methylbicyclo[2.2.1]hepto-endo-3-yl)methyl]bicyclo[2.2.1]-heptane which are represented by the following Formula (III):

[Ka 4]

(II)

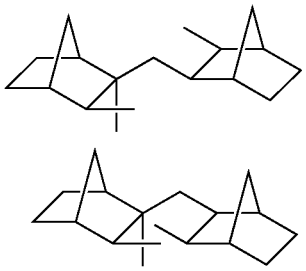

(III)

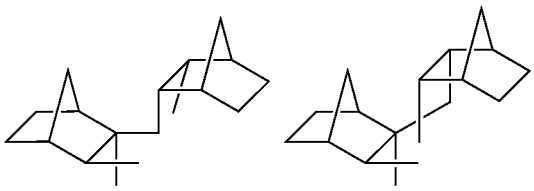

The above synthetic oil I may be used alone or in combination of two or more kinds thereof.

Synthetic Oil II:

In the lubricating oil of the present invention, the synthetic oil II constituting the base oil is preferably hydrocarbon compounds represented by the following Formulas (IV) to (IX):

[Ka 5]

(IV)

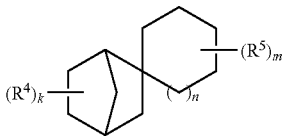

(V)

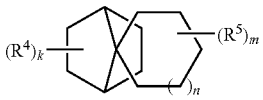

(VI)

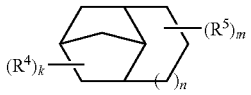

(VII)

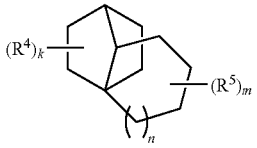

(VIII)

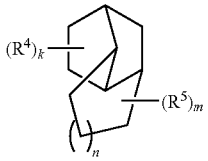

-continued (IX)

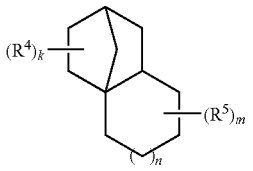

(wherein $R^4$ and $R^5$ each represent independently an alkyl group having 1 to 3 carbon atoms; k and m each represent independently an integer of 0 to 6, and n represents an integer of 0 to 2; and when plural $R^4$ and $R^5$ are present, plural $R^4$ and $R^5$ may be the same or different).

Compounds having a structure in which a 2-position and a 6-position or a 3-position and a 5-position in bicyclo[2.2.1] heptane are bonded are included as well in the hydrocarbon compounds represented by Formulas (IV) to (IX). Also, methyl, ethyl, n-propyl and isopropyl can be given as the alkyl group of $R^4$ and $R^5$.

The specific examples of the hydrocarbon compounds represented by Formulas (IV) to (IX) described above include, for example, 4,8,8,9-tetramethyldecahydro-1,4-methanoazulene, 1,1,5,5-tetramethyloctahydro-2H-2,4a-methanonaphthalene, 4-isopropyl-1,7a-dimethyl-octahydro-1,4-methano-indene, 4,7a,9,9-tetramethyloctahydro-1,3a-ethano-indene, 1,1,5,5,8-pentamethyl-octahydro-2,4a-methano-naphthalene, spiro[1,2,7,7-tetramethyl-bicyclo[2.2.1]heptane-3,1'-cyclopentane and spiro[1,2,7,7-tetramethyl-bicyclo[2.2.1] heptane-3,1'-cyclohexane.

The above synthetic oil II may be used alone or in combination of two or more kinds thereof.

In the lubricating oil of the present invention, a use amount of the synthetic oil II is determined according to the viscosity required at −40° C., and the more the use amount thereof is, the more the traction coefficient is reduced, so that the use amount thereof is preferably 3 to 20% by mass, more preferably 5 to 15% by mass based on the whole amount of the base oil.

In the lubricating oil for continuously variable transmissions according to the present invention, other compounds which have so far been used as a fluid for traction drive can suitably be added to the base oil as long as the effects of the present invention are not damaged. Further, various additive components, for example, at least one selected from antioxidants, viscosity index improvers, detergent dispersants, friction modifiers, metal deactivators, pour point depressants, anti-wear agents, deformers and extreme pressure agents can be added to the lubricating oil of the present invention as long as the effects of the present invention are not damaged.

Optional Additive Components:

In respect to the optional additive components, the antioxidants include, for example, amine base compounds such as alkylated diphenylamine, phenyl-α-naphthylamine and the like and phenol base compounds such as 2,6-di-t-butyl-4-methylphenol, 4,4'-methylenebis-(2,6-di-t-butylphenol) and the like; and the viscosity index improvers include polymethyl methacrylate base compounds, polyisobutylene base compounds, ethylene-propylene copolymers, styrene-isoprene copolymers and styrene-butadiene hydrogenated copolymers.

Further, the detergent dispersants include metal base dispersants such as alkali earth metal sulfonates, alkali earth metal phenates, alkali earth metal salicylates, alkali earth metal phosphonates and the like and ashless dispersants such as alkenylsuccinimide, benzylamine, alkyl polyamine, alkenylsuccinic esters and the like; the friction modifiers include aliphatic alcohols, fatty acids, fatty acids esters, aliphatic amines, fatty acid amine salts, fatty acid amides and the like; the metal deactivators include benzotriazole, thiadiazole, alkenylsuccinic esters and the like; the pour point depressants include polyalkyl methacrylate, polyalkylstyrene and the like; the anti-wear agents include organic molybdenum compounds such as MoDTP, MoDTC and the like, organic zinc compounds such as ZnDTP and the like, organic boron compounds such as alkylmercaptyl borate and the like and solid lubricant base anti-wear agents such as graphite, molybdenum disulfide, antimony sulfide, boron compounds, polytetrafluoroethylene and the like; the deformer include dimethylpolysiloxane, polyacrylates and the like; and the extreme pressure agents include sulfurated oil & fat, diphenyl sulfide, methyl trichlorostearate, chlorinated naphthalene and the like.

EXAMPLES

Next, the present invention shall be explained in further details with reference to examples, but the present invention shall by no means be restricted by these examples.

The properties of the fluids obtained in the respective examples were measured according to methods shown below.

(1) Kinematic Viscosity:

The kinematic viscosities at 40° C. and 100° C. were measured according to JIS K 2283.

(2) Viscosity Index:

Measured according to JIS K 2283.

(3) Brookfield Viscosity:

The viscosity at −40° C. was measured according to ASTM D2983.

(4) 15° C. Density:

Measured according to JIS K 2249.

(5) Traction Coefficient:

Measured according to the method described in the present specification.

(6) Ratio of Traction Coefficient to that of 2,4-dicyclohexyl-2-methylpentane:

Shown by % according to the following equation:

[(traction coefficient of each fluid at 120° C.)×100]/(traction coefficient of 2,4-dicyclohexyl-2-methylpentane at 120° C.)

Production Example 1

Production of Synthetic Oil I: Fluid 1

(1) Preparation of Raw Material Olefin

A stainless-made autoclave of 2 L was charged with 561 g (8 mole) of crotonaldehyde and 352 g (2.67 mole) of dicyclopentadiene, and the mixture was stirred at 170° C. for 3 hours to react them.

The reaction solution was cooled down to room temperature, and then 18 g of a sponge nickel catalyst (M-300T, manufactured by Kawaken Fine Chemicals Co., Ltd.) was added thereto to carry out hydrogenation at a hydrogen pressure of 0.9 MPa·G and a reaction temperature of 150° C. for 4 hours. After cooling down, the catalyst was separated by filtration, and then the filtrate was distilled under reduced pressure to obtain 565 g of a 105° C./2.65 kPa fraction. This fraction was analyzed by a mass spectrum and a nuclear magnetic resonance spectrum to result in observing that the above fraction was 2-hydroxymethyl-3-methylbicyclo[2.2.1] heptane and 3-hydroxymethyl-2-methylbicyclo[2.2.1]heptane. Then, a quartz glass-made flow atmospheric reaction tube having an outer diameter of 20 mm and a length of 500 mm was charged with 20 g of γ-alumina (N612N, manufactured by Nikki Chemical Co., Ltd.) to carry out dehydration reaction at a reaction temperature of 285° C. and a mass space velocity (WHSV) of 1.1 $hr^{-1}$ to obtain 490 g of a dehydration reaction product of 2-hydroxymethyl-3-methylbicyclo[2.2.1]heptane and 3-hydroxymethyl-2-methylbicyclo[2.2.1] heptane which contains 55% by mass of 2-methylene-3-methylbicyclo[2.2.1]heptane and 3-methylene-2-methylbicyclo[2.2.1]heptane and 30% by mass of 2,3-dimethylbicyclo[2.2.1]hepto-2-ene.

(2) Preparation of Dimer

A four neck flask of 1 L was charged with 8 g of a boron trifluoride diethyl ether complex and 400 g of the olefin compound obtained in (1) described above to carry out dimerization reaction at 0° C. for 6 hours while stirring by means of a mechanical stirrer. This reaction mixture was washed with a diluted NaOH aqueous solution and a saturated saline solution.

(3) Hydrogenation Step

An autoclave of 1 L was charged with 300 g of the olefin compound obtained in (2) described above and 12 g of a nickel/diatomaceous earth catalyst for hydrogenation (N-113, manufactured by Nikki Chemical Co., Ltd.) to carry out hydrogenation reaction on the conditions of a hydrogen pressure of 3 MPa·G, a reaction temperature of 180° C. and a reaction time of 2 hours. After finishing the reaction, the catalyst was separated by filtration, and the filtrate was distilled under reduced pressure to thereby obtain 240 g of a targeted dimer hydrogenation product (synthetic oil I: fluid 1). The measurement results of general properties and a traction coefficient of the fluid 1 are shown in Table 1.

Production Example 2

Production of Synthetic Oil I: Fluid 2

The same procedure as in the fluid 1 was carried out up to the step for preparation of the dimer.

An autoclave of 1 L was charged with 200 ml of isooctane and 9.0 g of a nickel/diatomaceous earth catalyst for hydrogenation (SN-750, manufactured by Sakai Chemical Industry Co., Ltd.) to activate the catalyst on the conditions of a hydrogen pressure of 3 MPa·G, a reaction temperature of 180° C. and a reaction time of 1 hour. The olefin compound 300 g obtained above was added thereto to carry out hydrogenation reaction at a hydrogen pressure of 3 MPa·G and a reaction temperature of 80° C. for a reaction time of 5 hours. Further, 9.0 g of 10 mass % Pd—C was added thereto to carry out reaction at a hydrogen pressure of 3 MPa·G and a reaction temperature of 150° C. for 1 hour. After finishing the reaction, the catalyst was separated by filtration, and the filtrate was distilled under reduced pressure to thereby obtain 240 g of a targeted dimer hydrogenation product (synthetic oil I: fluid 2). The measurement results of general properties and a traction coefficient of the fluid 2 are shown in Table 1.

Production Example 3

Production of Synthetic Oil I: Fluid 3

The fluid 2 described above was precisely distilled through a column having a diameter of 40 mm and a length of 120 cm charged with a filler to obtain a fraction having a boiling point of 137 to 139° C. at 266 Pa in a yield of 21% (synthetic oil I: fluid 3). The measurement results of general properties and a traction coefficient of the fluid 2 are shown in Table 1.

TABLE 1

| | | Production Example | | |
|---|---|---|---|---|
| | | 1 Fluid 1 | 2 Fluid 2 | 3 Fluid 3 |
| 40° C. kinematic viscosity | $mm^2/s$ | 25.34 | 27.97 | 28.8 |
| 100° C. kinematic viscosity | $mm^2/s$ | 4.407 | 4.644 | 4.741 |
| Viscosity index | — | 69 | 69 | 72 |
| 15° C. density | $g/cm^3$ | 0.9712 | 0.9744 | 0.9754 |
| −40° C. viscosity | Pa · s | 145 | 212 | 210 |

TABLE 1-continued

| | | Production Example | | |
|---|---|---|---|---|
| | | 1 Fluid 1 | 2 Fluid 2 | 3 Fluid 3 |
| Traction coefficient at 120° C. | — | 0.095 | 0.097 | 0.099 |
| Ratio of traction coefficient to that of 2,4-dicyclohexyl-2-methylpentane | (%) | 115.9 | 118.3 | 120.7 |

All of the fluids 1 to 3 are endowed with a high traction coefficient which has not so far been observed and have a high viscosity index, and a low temperature viscosity thereof is lower than that of DC2MP.

Production Example 4

Production of Fluid A

An autoclave of 2 L was charged with 1000 g of longifolene having a purity of 80% by mass (manufactured by Honghe Fine Chemical Co., Ltd.) and 30 g of the nickel/diatomaceous earth catalyst for hydrogenation (N-113, manufactured by Nikki Chemical Co., Ltd.) to carry out hydrogenation reaction at a hydrogen pressure of 3 MPa·G and a reaction temperature of 180° C. for 3 hours. After finishing the reaction, the catalyst was separated by filtration, and the filtrate was precisely distilled to thereby obtain 700 g of a targeted longifolene hydrogenation product (synthetic oil II: fluid A: 4,8,8,9-tetramethyldecahydro-1,4-methanoazulene). The measurement results of general properties and a traction coefficient of the fluid A are shown in Table 2.

Example 1

Production of Fluid 4

The fluid A produced in Production Example 4 was mixed with the fluid 1 so that a content thereof was 8% by mass of the whole mass to produce a fluid 4. The measurement results of general properties and a traction coefficient of the fluid 4 are shown in Table 2.

Example 2

Production of Fluid 5

The fluid A produced in Production Example 4 was mixed with the fluid 1 so that a content thereof was 15% by mass of the whole mass to produce a fluid 5. The measurement results of general properties and a traction coefficient of the fluid are shown in Table 2.

Example 3

Production of Fluid 6

The fluid A produced in Production Example 4 was mixed with the fluid 2 so that a content thereof was 8% by mass of the whole mass to produce a fluid 5. The measurement results of general properties and a traction coefficient of the fluid 6 are shown in Table 2.

Example 4

Production of Fluid 7

The fluid A produced in Production Example 4 was mixed with the fluid 2 so that a content thereof was 15% by mass of the whole mass to produce a fluid 7. The measurement results of general properties and a traction coefficient of the fluid 7 are shown in Table 2.

TABLE 2

| | | Production | Example | | | |
|---|---|---|---|---|---|---|
| | | Example 4 Fluid A | 1 Fluid 4 | 2 Fluid 5 | 3 Fluid 6 | 4 Fluid 7 |
| 40° C. kinematic viscosity | $mm^2/s$ | 8.347 | 22.76 | 20.77 | 24.89 | 22.55 |
| 100° C. kinematic viscosity | $mm^2/s$ | 2.518 | 4.187 | 4.008 | 4.414 | 4.216 |
| Viscosity index | — | 137 | 74 | 80 | 76 | 80 |
| 15° C. density | $g/cm^3$ | 0.9257 | 0.9682 | 0.9657 | 0.9709 | 0.9682 |
| −40° C. viscosity | Pa · s | 1> | 80 | 40 | 100 | 60 |
| Traction coefficient at 120° C. | — | 0.075 | 0.092 | 0.091 | 0.095 | 0.094 |
| Ratio of traction coefficient to that of 2,4-dicyclohexyl-2-methylpentane | (%) | | 112.2 | 111.0 | 115.9 | 114.6 |
| Remarks | | | Fluid 1 + 8% Fluid A | Fluid 1 + 15% Fluid A | Fluid 2 + 8% Fluid A | Fluid 2 + 15% Fluid A |

Production Example 5

Production of Fluid B

A four neck flask of 5 L was charged with 1000 g of the same longifolene as in Production Example 4 and 500 ml of acetic acid, and 500 ml of a boron trifluoride diethyl ether complex was dropwise added thereto in 4 hours while stirring at 20° C. to carry out isomerization. This reaction mixture was washed with ice and water, a saturated sodium hydrogencarbonate aqueous solution and a saturated saline solution and refined by distillation, and after refined by distillation, it was charged into an autoclave of 2 L together with 18 g of a palladium-carbon catalyst for hydrogenation to carry out hydrogenation (hydrogen pressure: 3 MPa·G, reaction temperature: 100° C., reaction time: 3 hours). After finishing the reaction, the catalyst was separated by filtration, and the filtrate was precisely distilled to thereby obtain 600 g of a targeted longifolene isomerized hydrogenation product (synthetic oil II: fluid B: 1,1,5,5-tetramethyloctahydro-2,4a-methanonaphthalene). The measurement results of general properties and a traction coefficient of the fluid B are shown in Table 3.

Example 5

Production of Fluid 8

The fluid B produced in Production Example 5 was mixed with the fluid 1 so that a content thereof was 8% by mass of the whole mass to produce a fluid 8. The measurement results of general properties and a traction coefficient of the fluid 8 are shown in Table 3.

Example 6

Production of Fluid 9

The fluid B produced in Production Example 5 was mixed with the fluid 1 so that a content thereof was 15% by mass of the whole mass to produce a fluid 9. The measurement results of general properties and a traction coefficient of the fluid 9 are shown in Table 3.

Example 7

Production of Fluid 10

The fluid B produced in Production Example 5 was mixed with the fluid 2 so that a content thereof was 8% by mass of the whole mass to produce a fluid 10. The measurement results of general properties and a traction coefficient of the fluid 10 are shown in Table 3.

Example 8

Production of Fluid 11

The fluid B produced in Production Example 5 was mixed with the fluid 2 so that a content thereof was 15% by mass of the whole mass to produce a fluid 11. The measurement results of general properties and a traction coefficient of the fluid 11 are shown in Table 3.

TABLE 3

| | | Production | Example | | | |
|---|---|---|---|---|---|---|
| | | Example 5 Fluid B | 5 Fluid 8 | 6 Fluid 9 | 7 Fluid 10 | 8 Fluid 11 |
| 40° C. kinematic viscosity | $mm^2/s$ | 6.425 | 22.18 | 19.81 | 24.2 | 21.42 |
| 100° C. kinematic viscosity | $mm^2/s$ | 2.198 | 4.135 | 3.916 | 4.334 | 4.085 |
| Viscosity index | — | 172 | 76 | 84 | 74 | 81 |
| 15° C. density | $g/cm^3$ | 0.9343 | 0.9682 | 0.9657 | 0.9711 | 0.9683 |
| −40° C. viscosity | Pa · s | 1> | 70 | 30 | 90 | 50 |
| Traction coefficient at 120° C. | — | 0.061 | 0.092 | 0.091 | 0.094 | 0.093 |

TABLE 3-continued

| | | Production Example 5 Fluid B | Example 5 Fluid 8 | 6 Fluid 9 | 7 Fluid 10 | 8 Fluid 11 |
|---|---|---|---|---|---|---|
| Ratio of traction coefficient to that of 2,4-dicyclohexyl-2-methylpentane | (%) | | 112.2 | 111.0 | 114.6 | 113.4 |
| Remarks | | | Fluid 1 + 8% Fluid B | Fluid 1 + 15% Fluid B | Fluid 2 + 8% Fluid B | Fluid 2 + 15% Fluid B |

Production Example 6

Production of Fluid C

A four neck flask of 2 L was charged with 1000 g of the same longifolene as in Production Example 4 and 100 g of bromoacetic acid to carry out reaction at 170° C. for 18 hours. This reaction mixture was washed with a saturated sodium hydrogencarbonate aqueous solution and water and refined by distillation, and after refined by distillation, it was charged into an autoclave of 2 L together with 18 g of a palladium-carbon catalyst for hydrogenation to carry out hydrogenation (hydrogen pressure: 6 MPa·G, reaction temperature: 100° C., reaction time: 2 hours). After finishing the reaction, the catalyst was separated by filtration, and the filtrate was precisely distilled to thereby obtain 200 g of targeted 2-isopropyl-1,7a-dimethyl-octahydro-1,4-methano-indene (synthetic oil II: fluid C). The measurement results of general properties and a traction coefficient of the fluid C are shown in Table 4.

Example 9

Production of Fluid 12

The fluid C produced in Production Example 6 was mixed with the fluid 1 so that a content thereof was 8% by mass of the whole mass to produce a fluid 12. The measurement results of general properties and a traction coefficient of the fluid 12 are shown in Table 4.

Example 10

Production of Fluid 13

The fluid C produced in Production Example 6 was mixed with the fluid 2 so that a content thereof was 8% by mass of the whole mass to produce a fluid 13. The measurement results of general properties and a traction coefficient of the fluid 13 are shown in Table 4.

TABLE 4

| | | Production Example 6 Fluid C | Example 9 Fluid 12 | 10 Fluid 13 |
|---|---|---|---|---|
| 40° C. kinematic viscosity | $mm^2/s$ | 4.723 | 21.34 | 23.28 |
| 100° C. kinematic viscosity | $mm^2/s$ | 1.724 | 4.025 | 4.216 |
| Viscosity index | — | — | 73 | 71 |
| 15° C. density | $g/cm^3$ | 0.9224 | 0.9673 | 0.9702 |
| −40° C. viscosity | Pa · s | 1> | 70 | 80 |

TABLE 4-continued

| | | Production Example 6 Fluid C | Example 9 Fluid 12 | 10 Fluid 13 |
|---|---|---|---|---|
| Traction coefficient at 120° C. | — | 0.062 | 0.091 | 0.092 |
| Ratio of traction coefficient to that of 2,4-dicyclohexyl-2-methylpentane | (%) | | 111.0 | 112.2 |
| Remarks | | | Fluid 1 + 8% Fluid C | Fluid 2 + 8% Fluid C |

Production Example 7

Production of Fluid D

A four neck flask of 3 L was charged with 680 ml of diethyl ether, and 360 g of conc. sulfuric acid and 920 g of β-caryophyllene (reagent, manufactured by Tokyo Chemical Industry Co., Ltd.) were slowly dropwise added thereto at 0° C. After 20 hours passed, the solution was washed with a sodium hydroxide aqueous solution, and the reaction mixture was taken out by steam distillation, separated by silica gel column chromatography and precisely distilled to obtain 100 g of a β-caryophyllene isomerized product. This was diluted to 300 ml with hexane and charged into an autoclave of 1 L together with 9 g of a palladium-carbon catalyst for hydrogenation to carry out hydrogenation (hydrogen pressure: 6 MPa·G, reaction temperature: 100° C., reaction time: 1 hour). After finishing the reaction, the catalyst was separated by filtration, and the filtrate was distilled under reduced pressure to thereby obtain 95 g of targeted 4,7a,9,9-tetramethyl-octahydro-1,3a-ethano-indene (synthetic oil II: fluid D). The measurement results of general properties and a traction coefficient of the fluid D are shown in Table 5.

Example 11

Production of Fluid 14

The fluid D produced in Production Example 7 was mixed with the fluid 1 so that a content thereof was 8% by mass of the whole mass to produce a fluid 14. The measurement results of general properties and a traction coefficient of the fluid 14 are shown in Table 5.

Example 12

Production of Fluid 15

The fluid D produced in Production Example 7 was mixed with the fluid 2 so that a content thereof was 8% by mass of the whole mass to produce a fluid 15. The measurement results of general properties and a traction coefficient of the fluid 15 are shown in Table 5.

TABLE 5

| | | Production Example 7 Fluid D | Example 11 Fluid 14 | Example 12 Fluid 15 |
|---|---|---|---|---|
| 40° C. kinematic viscosity | $mm^2/s$ | 5.563 | 21.79 | 23.77 |
| 100° C. kinematic viscosity | $mm^2/s$ | 1.938 | 4.079 | 4.274 |
| Viscosity index | — | — | 74 | 72 |
| 15° C. density | $g/cm^3$ | 0.9366 | 0.9684 | 0.9713 |
| −40° C. viscosity | Pa · s | 1> | 70 | 90 |
| Traction coefficient at 120° C. | — | 0.061 | 0.091 | 0.092 |
| Ratio of traction coefficient to that of 2,4-dicyclohexyl-2-methylpentane | (%) | | 111.0 | 112.2 |
| Remarks | | | Fluid 1 + 8% Fluid D | Fluid 2 + 8% Fluid D |

Production Example 8

Production of Fluid E

A four neck flask of 2 L was charged with 500 g of longifolene and 250 ml of acetic acid, and 250 ml of a boron trifluoride diethyl ether complex was dropwise added thereto in 4 hours while stirring at 20° C. to carry out isomerization reaction. This reaction mixture was washed with ice and water, a saturated sodium hydrogencarbonate aqueous solution and a saturated saline solution and refined by distillation, and after refined by distillation, it was mixed with 1800 ml of methylene chloride and 900 ml of a 0.5 mole/L sodium hydrogencarbonate aqueous solution, followed by slowly adding thereto 400 g of 3-chloroperbenzoic acid at 10° C. or lower. After finishing the reaction, the reaction mixture was washed with a 1 mole/L sodium hydroxide aqueous solution and water and concentrated under reduced pressure to obtain a crude product. It was dissolved in 3 L of toluene, and 260 ml of a boron trifluoride diethyl ether complex was slowly dropwise added thereto at 5° C. or lower. After finishing the reaction, the reaction mixture was washed with water and refined by distillation to thereby obtain 270 g of 1,1,5,5-tetramethylhexahydro-2H-2,4a-methano-naphthalene-8-one. This was dropwise added to 640 ml of a 2.1 mole/L methyl lithium/diethyl ether solution at 5° C. or lower to carry out alkylation, and after finishing the reaction, the reaction mixture was washed with a saturated ammonium chloride aqueous solution and water. This reaction product was charged into an autoclave of 1 L together with 30 g of the nickel/diatomaceous earth catalyst for hydrogenation (N-113, manufactured by Nikki Chemical Co., Ltd.) to carry out dehydration hydrogenation (hydrogen pressure: 6 MPa·G, reaction temperature: 250° C., reaction time: 6 hours).

After finishing the reaction, the catalyst was separated by filtration, and the filtrate was distilled under reduced pressure to thereby obtain 240 g of targeted 1,1,5,5,8-pentamethyloctahydro-2H-2,4a-methano-naphthalene (synthetic oil II: fluid E). The measurement results of general properties and a traction coefficient of the fluid D are shown in Table 6.

Example 13

Production of Fluid 16

The fluid E produced in Production Example 8 was mixed with the fluid 1 so that a content thereof was 8% by mass of the whole mass to produce a fluid 16. The measurement results of general properties and a traction coefficient of the fluid 16 are shown in Table 6.

Example 14

Production of Fluid 17

The fluid E produced in Production Example 8 was mixed with the fluid 1 so that a content thereof was 15% by mass of the whole mass to produce a fluid 17. The measurement results of general properties and a traction coefficient of the fluid 17 are shown in Table 6.

TABLE 6

| | | Production Example 8 Fluid E | Example 13 Fluid 16 | Example 14 Fluid 17 |
|---|---|---|---|---|
| 40° C. kinematic viscosity | $mm^2/s$ | 7.024 | 22.41 | 20.19 |
| 100° C. kinematic viscosity | $mm^2/s$ | 2.259 | 4.147 | 3.936 |
| Viscosity index | — | 143 | 74 | 80 |
| 15° C. density | $g/cm^3$ | 0.9239 | 0.9674 | 0.9641 |
| −40° C. viscosity | Pa · s | 1> | 80 | 50 |
| Traction coefficient at 120° C. | — | 0.066 | 0.093 | 0.092 |
| Ratio of traction coefficient to that of 2,4-dicyclohexyl-2-methylpentane | (%) | | 113.4 | 112.2 |
| Remarks | | | Fluid 1 + 8% Fluid E | Fluid 1 + 15% Fluid E |

Production Example 9

Production of Fluid F

A four neck flask of 2 L was charged with 600 ml of hexane and 195 g of sodium amide, and the suspension was heated and refluxed. A solution prepared by dissolving 304 g of camphor and 628 g of 1,4-dibromobutane in 600 ml of hexane was dropwise added thereto in 1 hour and refluxed as it was for 13 hours by heating. The reaction product was poured into a 10 mass % sulfuric acid aqueous solution and extracted with ethyl acetate, and the organic layer was dried, concentrated and then distilled under reduced pressure to obtain 326 g of spiro[1,7,7-trimethyl-bicyclo[2.2.1]heptane-2-one-3,1'-cyclopentane].

A four neck flask of 2 L was charged with 206 g of spiro[1,7,7-trimethyl-bicyclo[2.2.1]heptane-2-one-3,1'-cyclopentane] and 600 ml of diethyl ether, and 600 ml of a 2.1 mole/L methyl lithium/diethyl ether solution was dropwise added thereto at room temperature in one hour to carry out reaction at room temperature for 6 hours.

The reaction product was poured into a 10 mass % sulfuric acid aqueous solution and extracted with ethyl acetate, and the organic layer was dried and concentrated. The residue was charged into a Kjeldahl flask of 2 L, and 1 L of toluene and 1.8 g of p-toluenesulfonic acid were added thereto to carry out dehydration reaction for 2 hours. The reaction mixture was washed with a saturated sodium hydrogencarbonate aqueous solution, and the organic layer was dried and concentrated to obtain 204 g of spiro[1,7,7-trimethyl-2-methylene-bicyclo[2.2.1]heptane-3,1'-cyclopentane]. It was dissolved in hexane so that a solution amount was 600 ml, and 18 g of a palladium-carbon catalyst for hydrogenation was added thereto to carry out hydrogenation (hydrogen pressure: 4 MPa·G, reaction temperature: 40° C., reaction time: 6 hours) in an autoclave of 2 L. The reaction product was separated by filtration, concentrated and then distilled under reduced pressure to obtain 190 g of spiro[1,2,7,7-tetramethyl-bicyclo[2.2.1]heptane-3,1'-cyclopentane] (synthetic oil II: fluid F). The measurement results of general properties and a traction coefficient of the fluid F are shown in Table 7.

Example 15

Production of Fluid 18

The fluid F produced in Production Example 9 was mixed with the fluid 1 so that a content thereof was 8% by mass of the whole mass to produce a fluid 18. The measurement results of general properties and a traction coefficient of the fluid 18 are shown in Table 7.

Example 16

Production of Fluid 19

The fluid F produced in Production Example 7 was mixed with the fluid 2 so that a content thereof was 8% by mass of the whole mass to produce a fluid 19. The measurement results of general properties and a traction coefficient of the fluid 19 are shown in Table 7.

TABLE 7

| | | Production | Example | |
|---|---|---|---|---|
| | | Example 9 Fluid F | 15 Fluid 18 | 16 Fluid 19 |
| 40° C. kinematic viscosity | $mm^2/s$ | 6.250 | 22.10 | 24.12 |
| 100° C. kinematic viscosity | $mm^2/s$ | 2.141 | 4.123 | 4.321 |
| Viscosity index | — | 166 | 75 | 74 |
| 15° C. density | $g/cm^3$ | 0.9383 | 0.9686 | 0.9715 |
| −40° C. viscosity | Pa · s | 1> | 60 | 80 |
| Traction coefficient at 120° C. | — | 0.045 | 0.091 | 0.092 |
| Ratio of traction coefficient to that of 2,4-dicyclohexyl-2-methylpentane | (%) | | 111.0 | 112.2 |
| Remarks | | | Fluid 1 + 8% Fluid F | Fluid 2 + 8% Fluid F |

Production Example 10

Production of Fluid G

A four neck flask of 2 L was charged with 600 ml of hexane and 195 g of sodium amide, and the suspension was heated and refluxed. A solution prepared by dissolving 304 g of camphor and 690 g of 1,5-dibromopentane in 600 ml of hexane was dropwise added thereto in 1 hour and refluxed as it was for 13 hours by heating. The reaction product was poured into a 10 mass % sulfuric acid aqueous solution and extracted with ethyl acetate, and the organic layer was dried, concentrated and then distilled under reduced pressure to obtain 250 g of spiro[1,7,7-trimethyl-bicyclo[2.2.1]heptane-2-one-3,1'-cyclohexane].

A four neck flask of 2 L was charged with 220 g of spiro[1,7,7-trimethyl-bicyclo[2.2.1]heptane-2-one-3,1'-cyclohexane] and 600 ml of diethyl ether, and 600 ml of a 2.1 mole/L methyl lithium/diethyl ether solution was dropwise added thereto at room temperature in one hour to carry out reaction at room temperature for 6 hours.

The reaction product was poured into a 10 mass % sulfuric acid aqueous solution and extracted with ethyl acetate, and the organic layer was dried and concentrated. The residue was charged into a Kjeldahl flask of 2 L, and 1 L of toluene and 1.2 g of p-toluenesulfonic acid were added thereto to carry out dehydration reaction for 2 hours. The reaction mixture was washed with a saturated sodium hydrogencarbonate aqueous solution, and the organic layer was dried and concentrated to obtain 150 g of spiro[1,7,7-trimethyl-2-methylene-bicyclo[2.2.1]heptane-3,1'-cyclohexane]. It was dissolved in hexane so that a solution amount was 600 ml, and 18 g of a palladium-carbon catalyst for hydrogenation was added thereto to carry out hydrogenation (hydrogen pressure: 4 MPa·G, reaction temperature: 40° C., reaction time: 6 hours) in an autoclave of 2 L. The reaction product was separated by filtration, concentrated and then distilled under reduced pressure to obtain 80 g of spiro[1,2,7,7-tetramethyl-bicyclo[2.2.1]heptane-3,1'-cyclohexane] (synthetic oil II: fluid G). The measurement results of general properties and a traction coefficient of the fluid G are shown in Table 8.

Example 17

Production of Fluid 20

The fluid G produced in Production Example 10 was mixed with the fluid 1 so that a content thereof was 8% by mass of the whole mass to produce a fluid 20. The measurement results of general properties and a traction coefficient of the fluid 20 are shown in Table 8.

Example 18

Production of Fluid 21

The fluid G produced in Production Example 10 was mixed with the fluid 1 so that a content thereof was 15% by mass of the whole mass to produce a fluid 21. The measurement results of general properties and a traction coefficient of the fluid 21 are shown in Table 8.

TABLE 8

| | | Production | Example | |
|---|---|---|---|---|
| | | Example 10 Fluid G | 17 Fluid 20 | 18 Fluid 21 |
| 40° C. kinematic viscosity | $mm^2/s$ | 10.8 | 23.47 | 21.98 |
| 100° C. kinematic viscosity | $mm^2/s$ | 2.894 | 4.249 | 4.118 |
| Viscosity index | — | 119 | 73 | 77 |
| 15° C. density | $g/cm^3$ | 0.9486 | 0.9694 | 0.9678 |
| −40° C. viscosity | Pa · s | 1> | 90 | 60 |
| Traction coefficient at 120° C. | — | 0.072 | 0.093 | 0.092 |
| Ratio of traction coefficient to that of 2,4-dicyclohexyl-2-methylpentane | (%) | | 113.4 | 112.2 |
| Remarks | | | Fluid 1 + 8% Fluid G | Fluid 1 + 15% Fluid G |

All of the fluids produced in Examples 1 to 17 have a high traction coefficient, and they are enhanced in a viscosity index and reduced in a low temperature viscosity.

Comparative Example 1

Production of Fluid 22 (Described in WO 2003/014268)

A four neck flask of 500 ml equipped with a reflux condenser, a stirring device and a thermometer was charged with 4 g of activated clay (Gallenon Earth NS, manufactured by Mizusawa Industrial Chemical, Ltd.), 10 g of diethylene glycol monoethyl ether and 200 g of α-methylstyrene, and the mixture was heated at a reaction temperature of 105° C. and stirred for 4 hours. After finishing the reaction, the product liquid was analyzed by a gas chromatography to find that a conversion rate was 70%; a selectivity of the target product α-methylstyrene liner dimer) was 95%; a selectivity of the by-product (α-methylstyrene cyclic dimer) was 1%; and a selectivity of high boiling matters such as trimers and the like was 4%. The above reaction mixture was charged into an autoclave of 1 L together with 15 g of the nickel/diatomaceous earth catalyst for hydrogenation (N-113, manufactured by Nikki Chemical Co., Ltd.) to carry out hydrogenation (hydrogen pressure: 3 MPa·G, reaction temperature: 250° C., reaction time: 5 hours). The reaction product was separated by filtration, concentrated and then distilled under reduced pressure to thereby obtain 125 g of an α-methylstyrene liner dimer hydrogenation product having a purity of 99%, that is, 2,4-dicyclohexyl-2-methylpentane (fluid 22). The measurement results of general properties and a traction coefficient of the fluid 22 are shown in Table 9.

A traction coefficient and a viscosity index of the fluid 22 are low, and a low temperature viscosity thereof is high.

Comparative Example 2

Production of Fluid 23 (Described in Japanese Patent Application Laid-Open No. 17280/2000)

(1) Preparation of Raw Material Olefin

A stainless-made autoclave of 1 L was charged with 350.5 g (5 mole) of crotonaldehyde and 198.3 g (1.5 mole) of dicyclopentadiene, and the mixture was stirred at 170° C. for 2 hours to react them. The reaction solution was cooled down to room temperature, and then 22 g of a 5 mass % ruthenium-carbon catalyst (manufactured by N.E. Chemcat Corporation) was added thereto to carry out hydrogenation at a hydrogen pressure of 7 MPa·G and a reaction temperature of 180° C. for 4 hours. After cooling down, the catalyst was separated by filtration, and then the filtrate was distilled under reduced pressure to obtain 242 g of a 70° C./120 Pa fraction. This fraction was analyzed by a mass spectrum and a nuclear magnetic resonance spectrum to result in observing that the above fraction was 2-hydroxymethyl-3-methylbicyclo[2.2.1]heptane. Then, a quartz glass-made flow atmospheric reaction tube having an outer diameter of 20 mm and a length of 500 mm was charged with 15 g of γ-alumina (Norton Alumina SA-6273, manufactured by Nikka Seiko Co., Ltd.) to carry out dehydration reaction at a reaction temperature of 270° C. and a mass space velocity (WHSV) of 1.07 $hr^{-1}$ to obtain 196 g of a dehydrated reaction product of 2-hydroxymethyl-3-methylbicyclo[2.2.1]heptane containing 65% by mass of 2-methylene-3-methylbicyclo[2.2.1]heptane and 28% by mass of 2,3-dimethylbicyclo[2.2.1]hepto-2-ene.

(2) Preparation of Dimer Hydrogenation Product

A four neck flask of 500 ml was charged with 9.5 g of activated clay (Gallenon Earth NS, manufactured by Mizusawa Industrial Chemical, Ltd.) and 190 g of the olefin compound obtained in (1) described above to carry out dimerization reaction while stirring at 145° C. for 3 hours. After removing the activated clay from the reaction mixture by filtration, it was charged into an autoclave of 1 L together with 6 g of the nickel/diatomaceous earth catalyst for hydrogenation (N-113, manufactured by Nikki Chemical Co., Ltd.) to carry out hydrogenation reaction on the conditions of a hydrogen pressure of 4 MPa·G, a reaction temperature of 160° C. and a reaction time of 4 hours. After finishing the reaction, the catalyst was removed by filtration, and the filtrate was distilled under reduced pressure to thereby obtain 116 g of a dimer hydrogenation product (fluid 23) of a targeted fraction having a boiling point of 126 to 128° C. at 27 Pa. The measurement results of general properties and a traction coefficient of the above dimer hydrogenation product are shown in Table 9.

A viscosity index of the fluid 23 is low.

Comparative Example 3

Production of Fluid 24 (Described in Japanese Patent Application Laid-Open No. 17280/2000)

(1) Preparation of Raw Material Olefin

A stainless-made autoclave of 2 L was charged with 561 g (8 mole) of crotonaldehyde and 352 g (2.67 mole) of dicyclopentadiene, and the mixture was stirred at 170° C. for 3 hours to react them. The reaction solution was cooled down to room temperature, and then 18 g of a Raney nickel catalyst (M-300T, manufactured by Kawaken Fine Chemicals Co., Ltd.) was added thereto to carry out hydrogenation at a hydrogen pressure of 0.9 MPa·G and a reaction temperature of 150° C. for 4 hours. After cooling down, the catalyst was separated by filtration, and then the filtrate was distilled under reduced pressure to obtain 565 g of a 105° C./2.26 kPa fraction. This fraction was analyzed by a mass spectrum and a nuclear magnetic resonance spectrum to result in observing that the above fraction was 2-hydroxymethyl-3-methylbicyclo[2.2.1]heptane. Then, a quartz glass-made flow atmospheric reaction tube having an outer diameter of 20 mm and a length of 500 mm was charged with 20 g of γ-alumina (N612N, manufactured by Nikki Chemical Co., Ltd.) to carry out dehydration reaction at a reaction temperature of 285° C. and a mass space velocity (WHSV) of 1.1 $hr^{-1}$ to obtain 490 g of a dehydrated reaction product of 2-hydroxymethyl-3-methylbicyclo[2.2.1]heptane containing 55% by mass of 2-methylene-3-methylbicyclo[2.2.1]heptane and 30% by mass of 2,3-dimethylbicyclo[2.2.1]hepto-2-ene.

(2) Preparation of Dimer Hydrogenation Product

A four neck flask of 1 L was charged with 8 g of a boron trifluoride diethyl ether complex and 400 g of the olefin compound obtained in (1) described above to carry out dimerization reaction at 20° C. for 4 hours while stirring by means of a mechanical stirrer. After washing the above reaction mixture with a diluted NaOH aqueous solution and a saturated saline solution, it was charged into an autoclave of 1 L together with 12 g of the nickel/diatomaceous earth catalyst for hydrogenation (N-113, manufactured by Nikki Chemical Co., Ltd.) to carry out hydrogenation reaction on the conditions of a hydrogen pressure of 3 MPa·G, a reaction temperature of 250° C. and a reaction time of 6 hours. After finishing the reaction, the catalyst was removed by filtration, and the filtrate was distilled under reduced pressure to thereby obtain 240 g of a targeted dimer hydrogenation product (fluid 24). The measurement results of general properties and a traction coefficient of the above dimer hydrogenation product are shown in Table 9.

A traction coefficient of the fluid 24 is low.

Comparative Example 4

Production of Fluid 25

The fluid A produced in Example 1 was mixed with the fluid 22 produced in Comparative Example 1 so that a content thereof was 8% by mass of the whole mass to produce a fluid 25. The measurement results of general properties and a traction coefficient of the fluid 25 are shown in Table 9.

A traction coefficient and a viscosity index of the fluid 25 are low.

TABLE 9

| | | Comparative Example | | | |
|---|---|---|---|---|---|
| | | 1 Fluid 22 | 2 Fluid 23 | 3 Fluid 24 | 4 Fluid 25 |
| 40° C. kinematic viscosity | $mm^2/s$ | 20.23 | 24.26 | 16.97 | 18.60 |
| 100° C. kinematic viscosity | $mm^2/s$ | 3.572 | 4.208 | 3.519 | 3.462 |
| Viscosity index | — | 13 | 55 | 74 | 26 |
| 15° C. density | $g/cm^3$ | 0.9009 | 0.9651 | 0.9580 | 0.9036 |
| −40° C. viscosity | Pa · s | 260 | 200 | 40 | 90 |
| Traction coefficient at 120° C. | — | 0.082 | 0.092 | 0.086 | 0.081 |
| Ratio of traction coefficient to that of 2,4-dicyclohexyl-2-methylpentane | (%) | 100.0 | 112.2 | 104.9 | 98.8 |
| Remarks | | | | | Fluid 22 + 8% Fluid A |

TABLE 10

| | | Comparative Example | | | |
|---|---|---|---|---|---|
| | | 5 Fluid 26 | 6 Fluid 27 | 7 Fluid 28 | 8 Fluid 29 |
| 40° C. kinematic viscosity | $mm^2/s$ | 17.32 | 21.89 | 15.88 | 15.51 |
| 100° C. kinematic viscosity | $mm^2/s$ | 3.370 | 4.016 | 3.416 | 3.376 |
| Viscosity index | — | 37 | 62 | 80 | 82 |
| 15° C. density | $g/cm^3$ | 0.9060 | 0.9605 | 0.9561 | 0.9560 |
| −40° C. viscosity | Pa·s | 50 | 70 | 30 | 30 |
| Traction coefficient at 120° C. | — | 0.078 | 0.090 | 0.085 | 0.084 |
| Ratio of traction coefficient to that of 2,4-dicyclohexyl-2-methylpentane | (%) | 95.1 | 109.8 | 103.7 | 102.4 |
| Remarks | | Fluid 22 + 15% Fluid A | Fluid 23 + 8% Fluid A | Fluid 24 + 8% Fluid A | Fluid 24 + 8% Fluid B |

Comparative Example 5

Production of Fluid 26

The fluid A produced in Example 1 was mixed with the fluid 22 produced in Comparative Example 1 so that a content thereof was 15% by mass of the whole mass to produce a fluid 26. The measurement results of general properties and a traction coefficient of the fluid 26 are shown in Table 10.

A traction coefficient and a viscosity index of the fluid 26 are low.

Comparative Example 6

Production of Fluid 27

The fluid A produced in Example 1 was mixed with the fluid 23 produced in Comparative Example 2 so that a content thereof was 8% by mass of the whole mass to produce a fluid 27. The measurement results of general properties and a traction coefficient of the fluid 27 are shown in Table 10.

A traction coefficient of the fluid 27 is low, and a viscosity index thereof is low as well.

Comparative Example 7

Production of Fluid 28

The fluid A produced in Example 1 was mixed with the fluid 24 produced in Comparative Example 3 so that a content thereof was 8% by mass of the whole mass to produce a fluid 28. The measurement results of general properties and a traction coefficient of the fluid 28 are shown in Table 10.

A traction coefficient of the fluid 28 is low.

Comparative Example 8

Production of Fluid 29

The fluid B produced in Example 5 was mixed with the fluid 24 produced in Comparative Example 3 so that a content thereof was 8% by mass of the whole mass to produce a fluid 29. The measurement results of general properties and a traction coefficient of the fluid 29 are shown in Table 10.

A traction coefficient of the fluid 29 is low.

Industrial Applicability

The lubricating oil for continuously variable transmissions according to the present invention is a lubricating oil for continuously variable transmissions which has a high traction coefficient even at high temperature and is endowed with a good low temperature fluidity and which is suited as a lubricating oil for continuously variable transmissions for automobiles.

What is claimed is:

1. A lubricating oil suitable for continuously variable transmissions, comprising a base oil that comprises a synthetic oil I having the following properties:

(a) a traction coefficient at 120° C. is 115% or more of that of 2,4-dicyclohexyl-2-methylpentane, (b) a viscosity at −40° C. is not more than a viscosity (260 Pa·s) of 2,4-dicyclohexyl-2-methylpentane and (c) a viscosity index is 65 or more and a synthetic oil II having a viscosity of 1 Pa·s or less at −40° C.; and the base oil has the following properties:

(a') a traction coefficient at 120° C. is 110% or more of that of 2,4-dicyclohexyl-2-methylpentane, (b') a viscosity at −40° C. is 130 Pa·s or less and (c') a viscosity index is 70 or more, wherein the synthetic oil I comprises at least one compound represented by formulae (II) and (III):

(II)

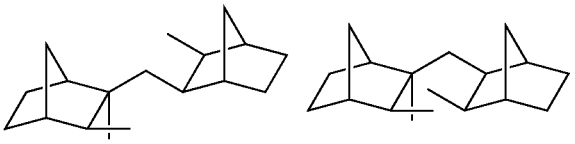

(III)

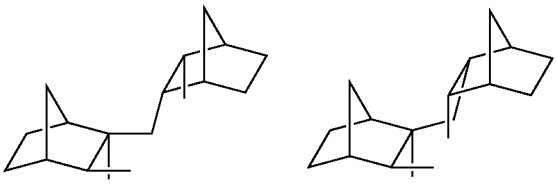

and wherein the synthetic oil II comprises at least one compound represented by formulae (IV) to (IX):

(IV)

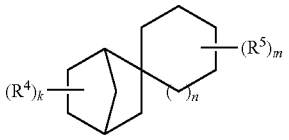

(V)

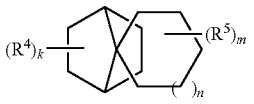

(VI)

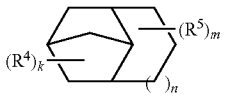

(VII)

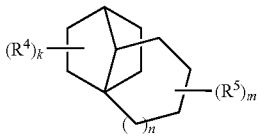

(VIII)

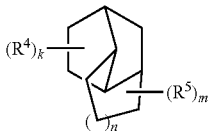

-continued (IX)

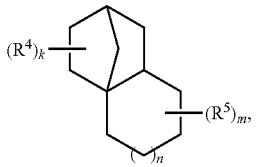

wherein $R^4$ and $R^5$ each represent independently an alkyl group having 1 to 3 carbon atoms; k and m each represent independently an integer of 0 to 6, and n represents an integer of 0 to 2;

and when plural $R^4$ and $R^5$ are present, plural $R^4$ and $R^5$ may be the same or different.

2. The lubricating oil according to claim 1, wherein a viscosity of the base oil at −40° C. is 60 Pa·s or less.

3. The lubricating oil according to claim 1, further comprising at least one additive selected from an antioxidant, a viscosity index improver, a detergent dispersant, a friction modifier, a metal deactivator, a pour point depressant, an anti-wear agent, a deformer and an extreme pressure agent.

4. The lubricating oil according to claim 1, comprising a compound of formula (II).

5. The lubricating oil according to claim 1, comprising a compound of formula (III).

6. The lubricating oil according to claim 1, comprising a compound of formula (IV).

7. The lubricating oil according to claim 1, comprising a compound of formula (V).

8. The lubricating oil according to claim 1, comprising a compound of formula (VI).

9. The lubricating oil according to claim 1, comprising a compound of formula (VII).

10. The lubricating oil according to claim 1, comprising a compound of formula (VIII).

11. The lubricating oil according to claim 1, comprising a compound of formula (IX).

* * * * *